US011187409B2

(12) United States Patent
Soliman et al.

(10) Patent No.: US 11,187,409 B2
(45) **Date of Patent: *Nov. 30, 2021**

(54) PYROPHORIC LIQUID IGNITION SYSTEM FOR PILOT BURNERS AND FLARE TIPS

(71) Applicant: Saudi Arabian Oil Company, Dhahran (SA)

(72) Inventors: Mohamed Soliman, Ras Tanura (SA); Ali Al Abbas, Qatif (SA)

(73) Assignee: Saudi Arabian Oil Company, Dhahran (SA)

( * ) Notice: Subject to any disclaimer, the term of this patent is extended or adjusted under 35 U.S.C. 154(b) by 173 days.

This patent is subject to a terminal disclaimer.

(21) Appl. No.: 16/710,589

(22) Filed: Dec. 11, 2019

(65) Prior Publication Data

US 2020/0116354 A1 Apr. 16, 2020

Related U.S. Application Data

(63) Continuation of application No. 15/690,139, filed on Aug. 29, 2017, now Pat. No. 10,514,166.

(51) Int. Cl.

| | |
|---|---|
| ***F23G 5/50*** | (2006.01) |
| ***F23Q 11/00*** | (2006.01) |
| ***F23N 5/10*** | (2006.01) |
| ***F23G 7/08*** | (2006.01) |
| ***F23Q 21/00*** | (2006.01) |
| ***F23Q 2/02*** | (2006.01) |

(52) U.S. Cl.

CPC ..... *F23G 5/50* (2013.01); *F23G 7/085* (2013.01); *F23N 5/102* (2013.01); *F23Q 2/02* (2013.01); *F23Q 11/00* (2013.01); *F23Q 21/00* (2013.01); *F23G 2207/101* (2013.01); *F23N 2227/00* (2020.01); *F23N 2227/22* (2020.01); *F23N 2227/40* (2020.01); *F23N 2241/18* (2020.01)

(58) Field of Classification Search

CPC . F23Q 11/50; F23Q 2/02; F23G 5/102; F23G 5/50; F23G 7/08; F23N 5/00; F23N 5/10

See application file for complete search history.

(56) References Cited

U.S. PATENT DOCUMENTS

| | | | | |
|---|---|---|---|---|
| 3,970,003 A | | 7/1976 | Hayward et al. | |
| 4,127,380 A | | 11/1978 | Straitz, III | |
| 4,147,498 A | | 4/1979 | Clarke | |
| 4,435,481 A | * | 3/1984 | Baldi | C23C 10/34 428/550 |

(Continued)

FOREIGN PATENT DOCUMENTS

| | | |
|---|---|---|
| CA | 1 054 508 A | 5/1979 |
| EP | 0 935 098 A1 | 8/1999 |
| WO | WO-2019/043541 A1 | 3/2019 |

OTHER PUBLICATIONS

Devold, H., Oil and gas production handbook, An introduction to oil and gas production, transport, refining and petrochemical industry, ABB, 162 pages (Aug. 2013).

(Continued)

*Primary Examiner* — David J Laux
*Assistant Examiner* — Nikhil P Mashruwala
(74) *Attorney, Agent, or Firm* — Choate, Hall & Stewart LLP; Michael A. Shinall; John P. Rearick

(57) ABSTRACT

Described herein are methods and systems for using pyrophoric liquids to ignite combustible gas.

12 Claims, 4 Drawing Sheets

(56) References Cited

U.S. PATENT DOCUMENTS

| | | | |
|---|---|---|---|
| 4,558,743 | A | 12/1985 | Ryan et al. |
| 4,634,369 | A | 1/1987 | McGill et al. |
| 5,163,511 | A | 11/1992 | Amundson et al. |
| 5,832,999 | A | 11/1998 | Ellwood |
| 5,862,858 | A | 1/1999 | Wellington et al. |
| 6,225,519 | B1 | 5/2001 | Matsunaga |
| 7,677,882 | B2 | 3/2010 | Harless |
| 8,629,313 | B2 | 1/2014 | Hong et al. |
| 10,514,166 | B2 | 12/2019 | Soliman et al. |
| 2007/0042306 | A1 | 2/2007 | Bacon |
| 2011/0308482 | A1 | 12/2011 | Hottovy |
| 2012/0015308 | A1 | 1/2012 | Hong et al. |
| 2012/0282555 | A1 | 11/2012 | Cody et al. |
| 2013/0022932 | A1 | 1/2013 | Kraus et al. |
| 2019/0063743 | A1 | 2/2019 | Soliman et al. |

OTHER PUBLICATIONS

International Search Report for PCT/IB2018/056446, 5 pages (dated Mar. 12, 2018).

* cited by examiner

PYROPHORIC LIQUID IGNITION SYSTEM FOR PILOT BURNERS AND FLARE TIPS

CROSS REFERENCE TO RELATED APPLICATIONS

The present application is a continuation of U.S. patent application Ser. No. 15/690,139, filed on Aug. 29, 2017 (now U.S. Pat. No. 10,514,166), the entirety of which is hereby incorporated by reference.

BACKGROUND

Flare stacks are gas combustion devices used in the oil refinery, chemical processing, and natural gas procurement industries for burning off flammable gases released during processing and procurement. During processing and procurement, combustible or natural gases can build up and be routed to a pressure release valve. When the pressure reaches a particular limit, or is otherwise opened via manual control, the gas travels through the piping in the stack to a flame located at the flare tip or the pilot light. Upon contact with the open flame, the gas will flare.

The gases that are flared tend to be waste gas, although it is possible that natural gases are flared when they cannot be recaptured and used during the refinery process. Gas flaring is important because it prevents natural and waste gases from escaping into the environment. Allowing these gases to simply escape into the environment risks harming the atmosphere (such as by methane gas, which is a greenhouse gas), or possibly poisoning nearby wildlife (such as by a sulfur-based gas). Flare stacks, therefore, play an important part in the refinery process.

SUMMARY

The present invention provides, among other things, methods and systems to address the problem of a flare tip extinguishing during routine use, for example methods and systems that ensure a flame is burning at the flare tip of a flare stack, or otherwise act as a back-up to ensure that a flame can be lit, should the normal lighting mechanism fail. Further, the present invention encompasses the recognition that operating flare stacks at colder temperatures can be problematic. For example, in cold weather environments, it is possible that wind could extinguish the flame, and cold weather may seize certain mechanisms used to re-light the flame.

Accordingly, the present disclosure provides, among other things, methods and systems for burning combustible waste gas using a pyrophoric liquid. In some embodiments, such methods and systems are useful in cold temperature conditions, such as −20° C., or −40° C. Using a pyrophoric liquid as a source of flame for the flare stack can avoid the pitfalls associated with known flare stacks.

In some embodiments, the present disclosure provides a method of burning a combustible waste gas, the method comprising:

exposing at least one pyrophoric liquid to air to create a flame;

contacting the flame with a pilot gas in the presence of a pilot burner to thereby ignite the pilot burner; and exposing the combustible waste gas to the ignited pilot burner, thereby burning the combustible waste gas.

In some embodiments, the present disclosure provides a flare ignition system comprising:

a. a pyrophoric liquid storage unit configured to an injection system;

b. a flare tip; and c. a detector configured to monitor a flame.

In some embodiments, the present disclosure provides a flare ignition system comprising:

a. a pyrophoric liquid storage unit configured to an injection system;

b. a flame front generator configured to receive air (or a source of oxygen) and at least one pyrophoric liquid from the injection system;

c. a flare tip; and d. a detector configured to monitor a flame.

In some embodiments, the present disclosure provides a method comprising the steps of:

exposing at least one pyrophoric liquid to air to create a flame; and igniting a flare stack or flare tip with the flame.

In some embodiments, the present disclosure provides a method of igniting a stream of combustible waste gas, the method comprising exposing at least one pyrophoric liquid to air to thereby ignite a flame;

contacting the flame with a pilot gas in the presence of a pilot burner to thereby ignite the pilot burner; and exposing the stream of combustible waste gas to the ignited pilot burner, thereby igniting the combustible waste gas.

In some embodiments, the present disclosure provides a method of igniting a stream of combustible waste gas, the method comprising exposing at least one pyrophoric liquid to air to thereby ignite a flame; and contacting the flame the combustible waste gas, thereby igniting the combustible waste gas.

DETAILED DESCRIPTION OF CERTAIN EMBODIMENTS

Definitions

Figure 1:
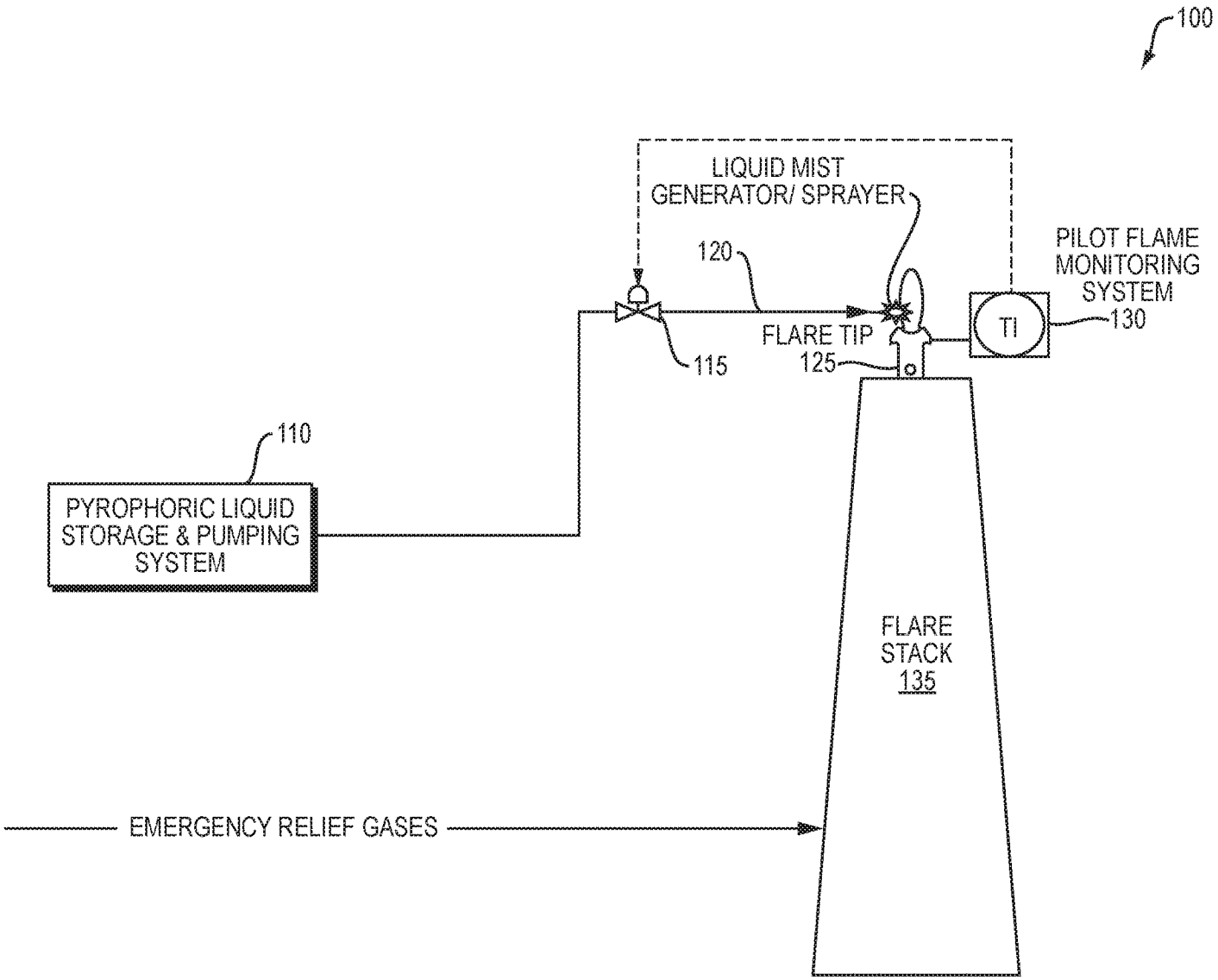
FIG. 1 is an illustration of a flare stack ignition system wherein the pyrophoric liquid storage unit provides pyrophoric liquid directly to the flare tip.

The term "pyrophoric liquid," as used herein, refers to liquids that have the potential to spontaneously ignite upon exposure to oxygen (e.g., air) at temperatures of 55° C. or below (e.g., 0° C. or below, −20° C. or below, or −40° C. or below). Some pyrophoric liquids can also ignite upon exposure to water. Exemplary pyrophoric liquids include, but are not limited to, organometallics of main group metals, (e.g., aluminum, gallium, indium, zinc, and cadmium), organoboranes, and organolithiums. Suitable pyrophoric liquids useful in the methods and systems described herein include, but are not limited to alkylaluminum (e.g., triethylaluminum), alkyllithium, alkenyllithium, aryllithium, alkynyllithium, alkylzinc, and alkylborane (e.g., triethylborane).

The term "alkyl," as used herein, means an unbranched or branched chain, saturated, monovalent hydrocarbon residue containing 1 to 10 carbon atoms ("$C_1$-$C_{10}$"). Suitable alkyl groups include, without limitation, methyl, ethyl, n- and iso-propyl, n-, sec-, iso- and tert-butyl, neopentyl, and the like.

The term "alkenyl," as used herein, means a monovalent straight or branched chain group of, unless otherwise specified, from 2 to 10 carbon atoms ("$C_2$-$C_{10}$") containing one or more carbon-carbon double bonds. Suitable alkenyl groups include, without limitation, ethenyl, propenyl, butenyl, pentenyl, hexenyl, and the like.

The term "alkynyl," as used herein, means a monovalent straight or branched chain group from 2 to 10 carbon atoms ("$C_2$-$C_{10}$") containing at least one carbon-carbon triple bond. Suitable alkynyl groups include, without limitation, ethynyl, propynyl, butynyl, pentynyl, hexynyl, and the like.

The term "aryl," as used herein, means monocyclic and bicyclic ring systems having a total of six to fourteen ring members, wherein at least one ring in the system is aromatic. The term "aryl" may be used interchangeably with the term "aryl ring". In certain embodiments, "aryl" refers to an aromatic ring system which includes, but not limited to, phenyl, biphenyl, naphthyl, anthracyl, and the like, which may bear one or more substituents. Also included within the scope of the term "aryl", as it is used herein, is a group in which an aromatic ring is fused to one or more non-aromatic rings, such as indanyl, phthalimidyl, naphthimidyl, phenanthridinyl, or tetrahydronaphthyl, and the like.

The term "combustible gas," or "combustible waste gas," as used herein, refers to any gas that, when mixed with oxygen (e.g., air) and contacted with a flame, will ignite. Exemplary combustible gases include methane, pentane, propane, butane, hydrogen, and hydrogen sulfide.

Flare Ignition Systems

In some embodiments, the present disclosure provides methods and systems for burning combustible waste gas using a pyrophoric liquid. Accordingly, in some embodiments, the present disclosure provides a flare ignition system comprising:

a. a pyrophoric liquid storage unit configured to an injection system;
b. a flare tip; and
c. a detector configured to monitor a flame.

In some embodiments, the at least one pyrophoric liquid comprises at least one of an alkylaluminum, an alkyllithium, an alkenyllithium, an aryllithium, an alkynyllithium, an alkylzinc, and an alkylborane. In some embodiments the at least one pyrophoric liquid comprises at least one of an alkylaluminum and an alkylborane. In some embodiments, the at least one pyrophoric liquid comprises triethylaluminum, triethylborane, or a combination thereof. In some embodiments, the at least one pyrophoric liquid comprises a mixture of triethylaluminum and triethylborane.

For example, as seen in FIG. 1, a flare ignition system 100 comprises: a pyrophoric liquid storage unit 110 containing at least one pyrophoric liquid; an injection system 120; a flare tip 125; and a detector 130 configured to monitor a flame. The injection system 120 is configured such that it can pump or otherwise cause the release of the at least one pyrophoric liquid from a pyrophoric liquid storage unit 110 to a flare tip 125. The pyrophoric liquid, upon exposure to the air will ignite, generating a flame.

The flare ignition system 100 in FIG. 1 is configured to a flare stack 135. The flare stack is configured to receive waste combustible gas or other emergency relief gases that are combustible. In typical refinery processes, waste or natural gases will travel through a pipeline to and through a flare stack 135, where they are exposed to the outside air at a flare tip 125. If a flame is present at a flare tip 125, a combustible gas will ignite, burning the gas off before it enters the atmosphere.

In some embodiments, as also seen in FIG. 1, a flare ignition system further comprises a control valve 115 configured to an injection system 120. In some embodiments, a control valve 115 is configured to receive a signal from a detector 130 or another source (e.g., a signal received from a terminal operated by a human). A signal sent to a control valve 115 will cause an injection system 120 to pump or otherwise cause the release of the at least one pyrophoric liquid.

In some embodiments, a detector 130 is configured to monitor a flame at a flare tip 125. In certain embodiments, a detector 130 monitors the flame via a thermocouple sensor capable of measuring temperature, an infrared sensor capable of measuring infrared radiation, a closed circuit television monitoring the flame, an ultraviolet sensor capable of measuring ultraviolet radiation, a flame ionization detector capable of measuring organic species in a gas stream, or any combination of thereof. In some embodiments, a detector 130 comprises a thermocouple sensor capable of measuring temperature. In some embodiments, a detector 130 comprises an infrared sensor capable of measuring infrared radiation. A detector 130, measuring a change in temperature or a change in infrared radiation, will send a signal to a control valve 115, thereby causing an injection system 120 to pump or otherwise cause the release of pyrophoric liquid from a pyrophoric liquid storage unit 110 to a flare tip 125.

Figure 2:
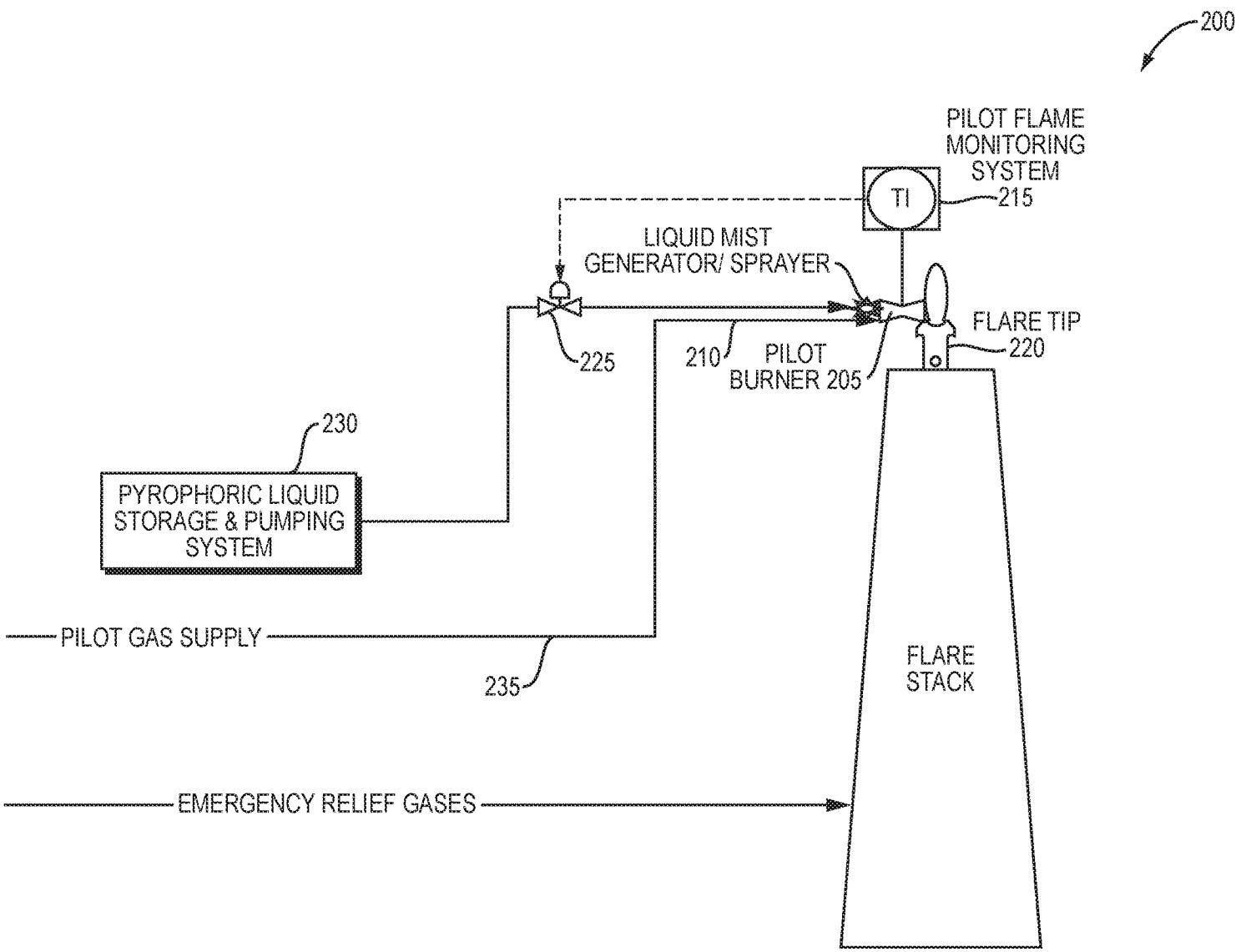
FIG. 2 is an illustration of a flare stack ignition system wherein the pyrophoric liquid storage unit provides pyrophoric liquid to a pilot burner.

FIG. 2 is an illustration of a flare ignition system comprising a pilot burner. As seen in FIG. 2, in some embodiments, a flare ignition system 200 comprises a pilot burner 205 configured adjacent to an injection system 210. In some embodiments, a pilot burner is configured to receive pilot gas from a pilot gas inlet pipe 235, thereby causing the pilot burner to comprise a flame that is continuously lit (until the pilot gas, combustible gas, or any suitable fuel is exhausted). When an ignition system 200 comprises a pilot burner, a detector 215 is configured to monitor either a pilot burner 205 or a flare tip 220, or both. Similar to the configuration illustrated in FIG. 1, if a detector 215 measures a change in, for example, temperature or infrared radiation, a signal is sent to a control valve 225, thereby causing an injection system 210 to pump or otherwise cause the release of pyrophoric liquid from a pyrophoric liquid storage unit 230 to either a pilot burner 205 or a flare tip 220.

In some embodiments, the present disclosure provides a flare ignition system comprising:

a. a pyrophoric liquid storage unit configured to an injection system;
b. a flame front generator configured to receive oxygen (e.g., air) and at least one pyrophoric liquid from a pyrophoric liquid mist generator;
c. a flare tip; and
d. a detector configured to monitor a flame, wherein, in some embodiments, the at least one pyrophoric liquid is defined above.

Figure 3:
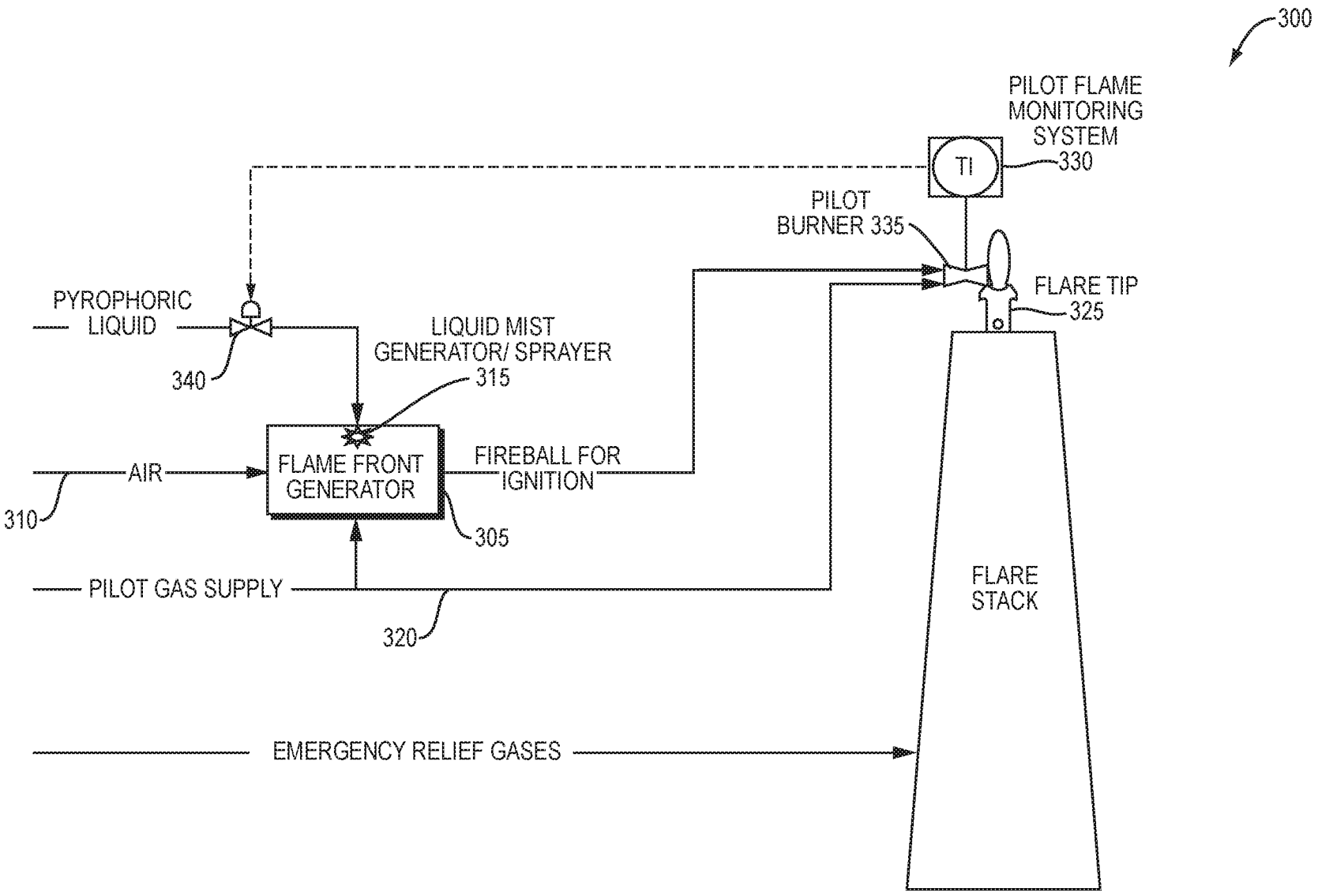
FIG. 3 is an illustration of a flare stack ignition system comprising a flame front generator.

FIG. 3 is an illustration of an ignition system 300 comprising a flame front generator 305. The flame front generator 305 is configured to receive a source of air 310 (or in some embodiments, a source of oxygen) and at least one pyrophoric liquid from an injection system 315. In some embodiments, a flame front generator can also receive a pilot gas supply 320.

Pyrophoric liquid can be housed in a pyrophoric liquid storage unit (not pictured) and pumped into a flame front generator 305 via an injection system 315. Upon exposure of pyrophoric liquid to oxygen or air with a flame front generator 305, a flame can be ignited, and travel to a flare tip 325.

Similar to the exemplary embodiment rendered in FIG. 1, the embodiment rendered in FIG. 3 comprises a detector 330. A detector 330 is configured to monitor a flame at a flare tip 325 or a pilot burner 335. A detector 330 can monitor a flame by monitoring changes in temperature (e.g., by a thermocouple temperature sensor) or in infrared radiation. If a detector 330 recognizes a change, it can send a signal to a control valve 340, thereby causing the injection system 315 to pump or otherwise cause the release of pyrophoric liquid into a flame front generator 305.

It should be noted that, while the flare ignition system of FIG. 3 comprises a pilot burner 335, a person of skill in the art would understand that this embodiment, like the embodiment rendered in FIG. 1, can also be constructed without a pilot burner.

Figure 4:
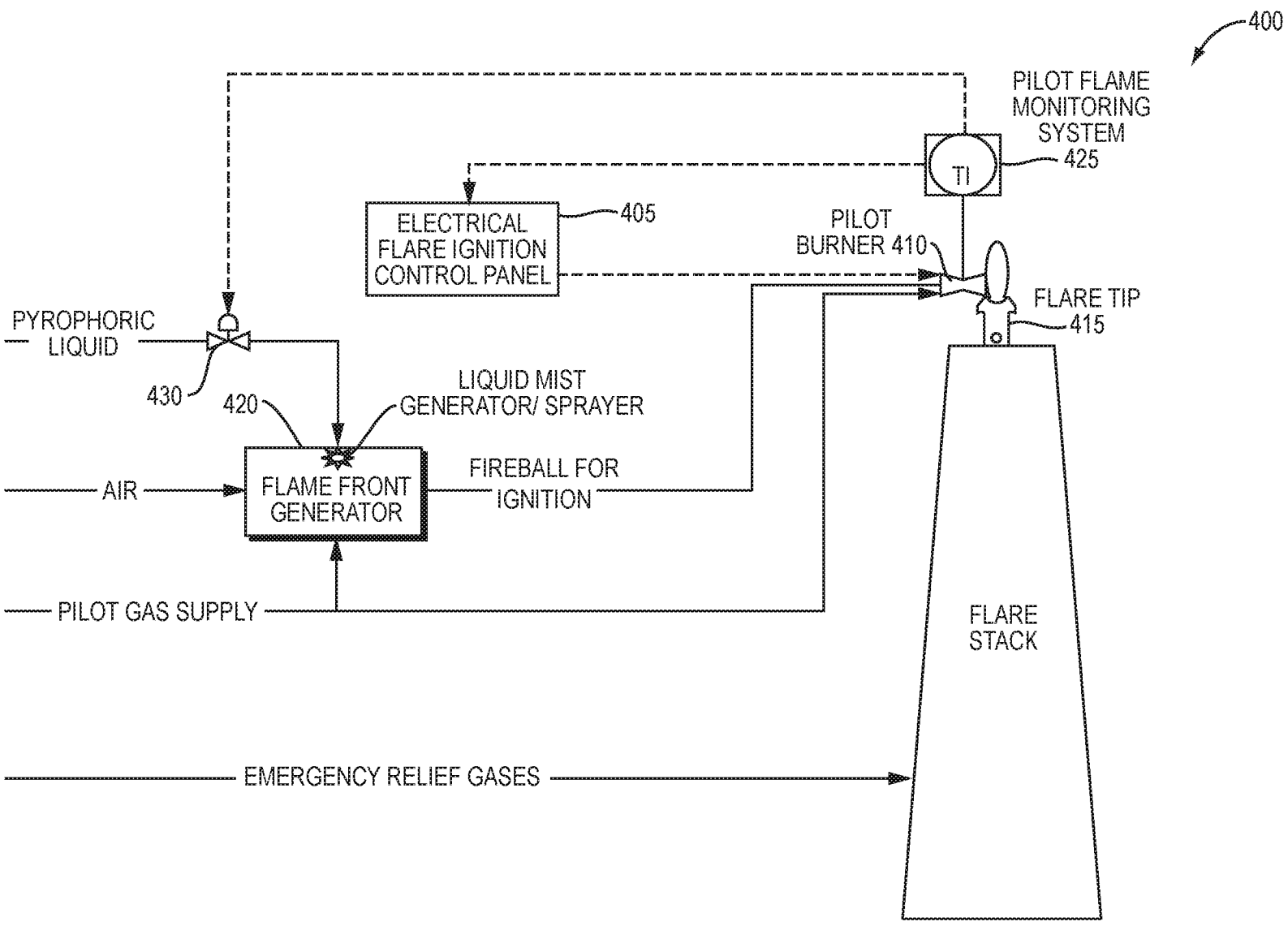
FIG. 4 is an illustration of a flare stack ignition system comprising both a flame front generator and a sparking mechanism.

FIG. 4 is an illustration of a flare ignition system 400 comprising a sparking mechanism 405. It should be understood that any embodiment described herein may optionally comprise a sparking mechanism, such as the exemplary embodiments described with respect to FIGS. 1 and 2. A sparking mechanism 405 (e.g., an electrical flare ignition, optionally with control panel) provides an electrical spark to, for example, a pilot burner 410, a flare tip 415, or a flame front generator 420.

In some embodiments, a detector 425 is configured to monitor either a pilot burner 410 (when present) or a flare tip 415. Similar to the configuration illustrated in FIG. 3, if a detector 425 measures a change in, for example, temperature or infrared radiation, a signal is sent to a control valve 430, thereby causing an injection system 430 to pump or otherwise cause the release of pyrophoric liquid into a flame front generator. Additionally, in some embodiments, a detector 425 is configured to send a signal to a sparking mechanism 405 when a detector 425 measures a change in, for example, temperature or infrared radiation. A signal received by a sparking mechanism 405 causes a sparking mechanism to light a flame at a pilot burner 410 or a flare tip 415.

In some embodiments, flare ignition systems described herein do not comprise a sparking mechanism.

In some embodiments, the present disclosure provides a flare stack comprising any of the flare ignition systems described herein.

In some embodiments, the present disclosure provides flare ignition systems configured to operate at a temperature of 0° C. or less. In some embodiments, a flare ignition system is configured to operate at a temperature of −20° C. or less. In some embodiments, the flare ignition system is configured to operate at a temperature of −40° C. or less.

Methods of Disposing of Waste Gas

The present disclosure also provides methods of disposing of waste gas through the use of pyrophoric liquids. Accordingly, in some embodiments, the present disclosure provides a method of burning a combustible waste gas, the method comprising exposing at least one pyrophoric liquid to oxygen (e.g., air) to create a flame;

contacting the flame with a pilot gas in the presence of a pilot burner to thereby ignite the pilot burner; and exposing the combustible waste gas to the ignited pilot burner, thereby burning the combustible waste gas, wherein the at least one pyrophoric liquid is defined above.

In some embodiments, the present disclosure provides a method comprising the steps of:

exposing at least one pyrophoric liquid to air to create a flame; and igniting a flare stack/flare tip with the flame.

wherein the at least one pyrophoric liquid is defined above.

In some embodiments, the present disclosure provides a method of igniting a stream of combustible waste gas, the method comprising:

exposing at least one pyrophoric liquid to air to thereby ignite a flame;

contacting the flame with a pilot gas in the presence of a pilot burner to thereby ignite the pilot burner; and exposing the stream of combustible waste gas to the ignited pilot burner, thereby igniting the combustible waste gas.

wherein the at least one pyrophoric liquid is defined above.

In some embodiments, the present disclosure provides a method of igniting a stream of combustible waste gas, the method comprising:

exposing at least one pyrophoric liquid to air to thereby ignite a flame;

contacting the flame the combustible waste gas, thereby igniting the combustible waste gas.

wherein the at least one pyrophoric liquid is defined above.

The foregoing has been a description of certain non-limiting embodiments of the invention. Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

It is contemplated that systems, devices, methods, and processes of the claimed invention encompass variations and adaptations developed using information from the embodiments described herein. Adaptation and/or modification of the systems, devices, methods, and processes described herein may be performed by those of ordinary skill in the relevant art.

Throughout the description, where articles, devices, and systems are described as having, including, or comprising specific components, or where processes and methods are described as having, including, or comprising specific steps, it is contemplated that, additionally, there are articles, devices, and systems of the present invention that consist essentially of, or consist of, the recited components, and that there are processes and methods according to the present invention that consist essentially of, or consist of, the recited processing steps.

It should be understood that the order of steps or order for performing certain action is immaterial so long as the invention remains operable. Moreover, two or more steps or actions may be conducted simultaneously.

It is contemplated that systems, devices, methods, and processes of the claimed invention encompass variations and adaptations developed using information from the embodiments described herein. Adaptation and/or modification of the systems, devices, methods, and processes described herein may be performed by those of ordinary skill in the relevant art.

Throughout the description, where articles, devices, and systems are described as having, including, or comprising specific components, or where processes and methods are described as having, including, or comprising specific steps, it is contemplated that, additionally, there are articles, devices, and systems of the present invention that consist essentially of, or consist of, the recited components, and that there are processes and methods according to the present invention that consist essentially of, or consist of, the recited processing steps.

It should be understood that the order of steps or order for performing certain action is immaterial so long as the invention remains operable. Moreover, two or more steps or actions may be conducted simultaneously.

The invention claimed is:

1. A method of igniting a stream of combustible waste gas, the method comprising steps of:

exposing at least one pyrophoric liquid to air to thereby ignite a flame;

contacting the flame with a pilot gas in the presence of a pilot burner to thereby ignite the pilot burner; and exposing the stream of combustible waste gas to the ignited pilot burner, thereby igniting the combustible waste gas.

2. The method of claim 1, wherein the at least one pyrophoric liquid comprises at least one of an alkylaluminum, an alkyllithium, an alkenyllithium, an aryllithium, an alkynyllithium, an alkylzinc, and an alkylborane.

3. The method of claim 2, wherein the at least one pyrophoric liquid comprises at least one of an alkylaluminum and an alkylborane.

4. The method of claim 3, wherein the at least one pyrophoric liquid comprises triethylaluminum, triethylborane, or a combination thereof.

5. The method of claim 4, wherein the at least one pyrophoric liquid comprises a mixture of triethylaluminum and triethylborane.

6. A method of igniting a stream of combustible waste gas, the method comprising steps of:

exposing at least one pyrophoric liquid to air to thereby ignite a flame; and contacting the flame with the combustible waste gas, thereby igniting the combustible waste gas, wherein the step of exposing at least one pyrophoric liquid to air occurs at a temperature of 0° C. or lower.

7. The method of claim 6, wherein the at least one pyrophoric liquid comprises at least one of an alkylaluminum, an alkyllithium, an alkenyllithium, an aryllithium, an alkynyllithium, an alkylzinc, and an alkylborane.

8. The method of claim 7, wherein the at least one pyrophoric liquid comprises at least one of an alkylaluminum and an alkylborane.

9. The method of claim 8, wherein the at least one pyrophoric liquid comprises triethylaluminum, triethylborane, or a combination thereof.

10. The method of claim 9, wherein the at least one pyrophoric liquid comprises a mixture of triethylaluminum and triethylborane.

11. The method of claim 6, wherein the step of exposing at least one pyrophoric liquid to air occurs at a temperature of 0° C. or −20° C.

12. The method of claim 6, wherein the step of exposing at least one pyrophoric liquid to air occurs at a temperature of 0° C. or −40° C.

* * * * *